US008542053B2

(12) United States Patent
Lin et al.

(10) Patent No.: US 8,542,053 B2
(45) Date of Patent: Sep. 24, 2013

(54) HIGH-LINEARITY TESTING STIMULUS SIGNAL GENERATOR

(75) Inventors: Chun-Wei Lin, Yunlin County (TW); Yi-Cang Wu, Yunlin County (TW)

(73) Assignee: National Yunlin University of Science and Technology, Yunlin County (TW)

( * ) Notice: Subject to any disclaimer, the term of this patent is extended or adjusted under 35 U.S.C. 154(b) by 370 days.

(21) Appl. No.: 13/092,531

(22) Filed: Apr. 22, 2011

(65) Prior Publication Data

US 2012/0268192 A1 Oct. 25, 2012

(51) Int. Cl.
*G06G 7/12* (2006.01)

(52) U.S. Cl.
USPC ..... 327/362; 327/262

(58) Field of Classification Search
USPC ..... 327/262, 362, 378, 513
See application file for complete search history.

(56) References Cited

U.S. PATENT DOCUMENTS

| | | | | |
|---|---|---|---|---|
| 6,107,870 | A * | 8/2000 | Kawano | 327/553 |
| 7,834,676 | B2 * | 11/2010 | Lee et al. | 327/362 |
| 8,390,356 | B2 * | 3/2013 | Shinde | 327/262 |
| 2009/0040199 | A1 | 2/2009 | Lee et al. | |

* cited by examiner

*Primary Examiner* — Hai L Nguyen
(74) *Attorney, Agent, or Firm* — Muncy, Geissler, Olds & Lowe, PLLC

(57) ABSTRACT

A high-linearity testing stimulus signal generator comprises a signal collection unit receiving an input current signal, a waveform conversion unit connecting with the signal collection unit, a first voltage-to-current conversion unit connecting with the waveform conversion unit, a delay unit connecting with the waveform conversion unit, a second voltage-to-current conversion unit connecting with the delay unit, a current comparison unit connecting respectively with the first voltage-to-current conversion unit and the second voltage-to-current conversion unit, an error calculation unit connecting with the current comparison unit, and a compensation unit connecting with the error calculation unit. The above-mentioned structure forms a feedback mechanism to perform compensation adjustment to promote the linearity of the output signals. Thus, the present invention can generate high-accuracy testing stimulus signals.

6 Claims, 7 Drawing Sheets

HIGH-LINEARITY TESTING STIMULUS SIGNAL GENERATOR

FIELD OF THE INVENTION

The present invention relates to a signal generator, particularly to a high-linearity testing stimulus signal generator.

BACKGROUND OF THE INVENTION

With the advance of information technology, the audio/video files need higher and higher resolution and demand greater and greater storage capacity. A high-quality terminal device should be equipped with a high-performance data transmission system to transmit an enormous amount of data. Thus, ADC (Analog to Digital Converter), which functions as a conversion interface, demands higher and higher specification, some of which may be far beyond the range that the testing stimulus signal generators can operate. Hence, the high-resolution ADC is usually performed verification by lowering the resolution thereof during testing. Consequently, the test results are usually unpractical.

A US Publication No. 20090040199 entitled an "Apparatus for Testing Driving Circuit for Display" discloses an analog-to-digital converter having a ramp generator. The ramp generator generates a linear triangular wave or a ramp wave (the so-called testing stimulus signal) for testing the analog-to-digital converter. The fundamental problems of a ramp generator include whether the linearity of signals can be used for testing the circuit under test having higher and higher resolution, whether it is expensive, whether the test result thereof is as accurate as expected when considering the non-ideality of the fabrication process, whether it can overcome the factors of environmental interference, probe pointing, loads, etc., and whether it is practical to generate testing stimulus signals externally to input to a chip in case of SOC (System-on-a-Chip). A digital-to-analog converter can provide testing stimulus signals. However, a high-resolution digital-to-analog converter built in a chip not only is expensive but also increases the complexity of design and integration of the chip.

Another typical method for generating testing stimulus signals is to connect a constant current source to a capacitor. Refer to FIG. 1. Via a constant current source 1 and a capacitor 2, the output current can be converted into the voltage drop of the capacitor 2, which is a testing stimulus signal desired. The constant current source 1 is provided by incorporating a current mirror with great output impedance. Such a method is instinctive. However, the method can only apply to a chip where a constant current source 1 and a capacitor 2 exist simultaneously. Refer to FIG. 2. In practice, the constant current source 1 and the capacitor 2 are non-ideal and have parasitic effects which causes the stray charging curve 3 pretty different from the ideal charging curve 4.

SUMMARY OF THE INVENTION

The primary objective of the present invention is to solve the linearity problem of the testing stimulus signals.

Another objective of the present invention is to reduce the high cost of high-linearity testing stimulus generators.

To achieve the above-mentioned objectives, the present invention proposes a high-linearity testing stimulus generator, which comprises a signal collection unit, a waveform conversion unit, a first voltage-to-current conversion unit, a delay unit, a second voltage-to-current conversion unit, a current comparison unit, an error calculation unit and a compensation unit.

The signal collection unit receives an input current signal and outputs a signal. The waveform conversion unit connects with the signal collection unit, converts the signal output by the signal collection unit into a triangular wave voltage signal, and outputs the triangular wave voltage signal via a voltage output terminal. The first voltage-to-current conversion unit and the delay unit connect with the voltage output terminal of the waveform conversion unit. The first voltage-to-current conversion unit converts the triangular wave voltage signal into a first current signal. The delay unit delays propagation time of the triangular wave voltage signal. The second voltage-to-current conversion unit connects with the delay unit and converts the delayed triangular wave voltage signal into a second current signal. The current comparison unit connects respectively with the first voltage-to-current conversion unit and the second voltage-to-current conversion unit to receive the first current signal and the second current signal and then perform comparison thereof to output a current difference signal. The error calculation unit connects with the output terminal of the current comparison unit to receive the current difference signal and perform error calculation to output an error signal. The compensation unit connects with the error calculation unit to receive the error signal and perform signal compensation to output a compensation signal to the signal collection unit. Thus is formed a feedback mechanism.

Thereby, when the waveform conversion unit outputs a non-linear triangular wave voltage signal, the feedback mechanism performs compensation adjustment to restore the non-linear triangular wave voltage signal to a linear signal, therefore is able to function as a high-accuracy testing stimulus signal.

DETAILED DESCRIPTION OF THE PREFERRED EMBODIMENTS

The technical contents of the present invention are described in detail in cooperation with the drawings below.

Figure 1:
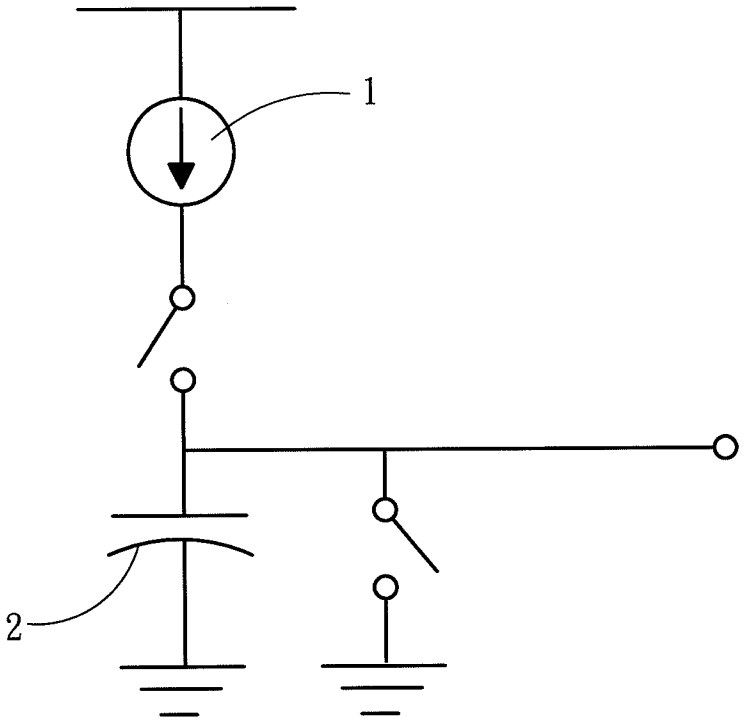
Fig. 1 PRIOR ART
FIG. 1 is a diagram schematically showing a constant current source and a capacitor in a conventional technology.
Figure 2:
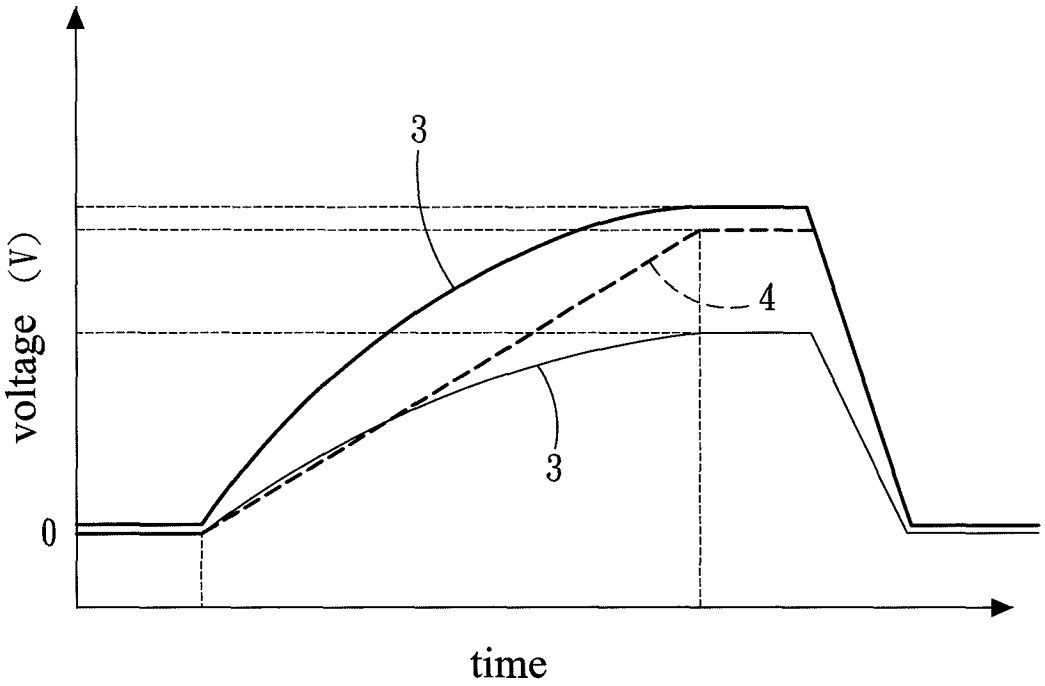
Fig. 2 PRIOR ART
FIG. 2 is a diagram schematically showing voltage variation of a charged capacitor in a conventional technology.
Figure 3A:
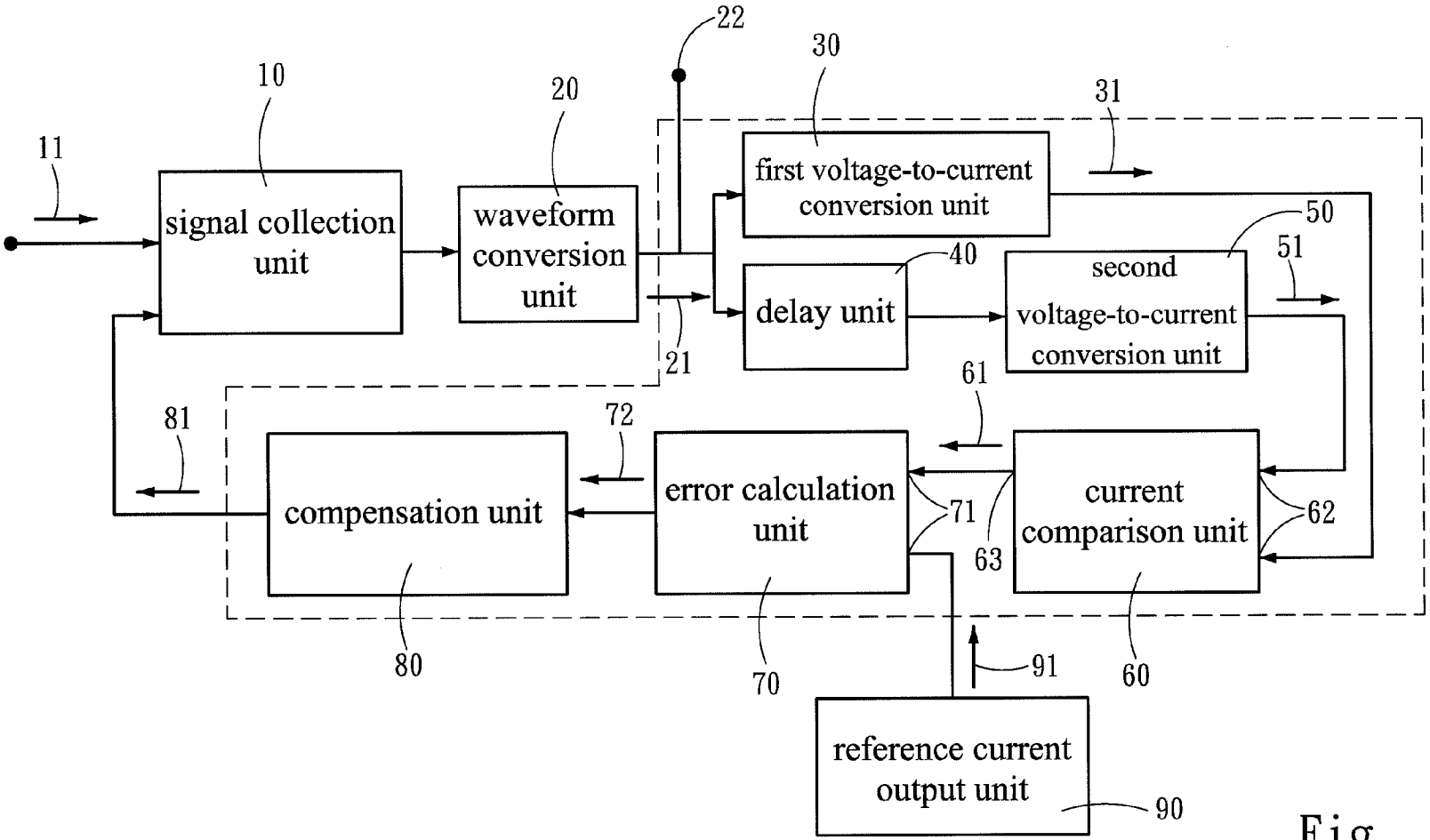
FIG. 3A is a block diagram schematically showing the architecture of a high-linearity testing stimulus signal generator according to one embodiment of the present invention.
Figure 3B:
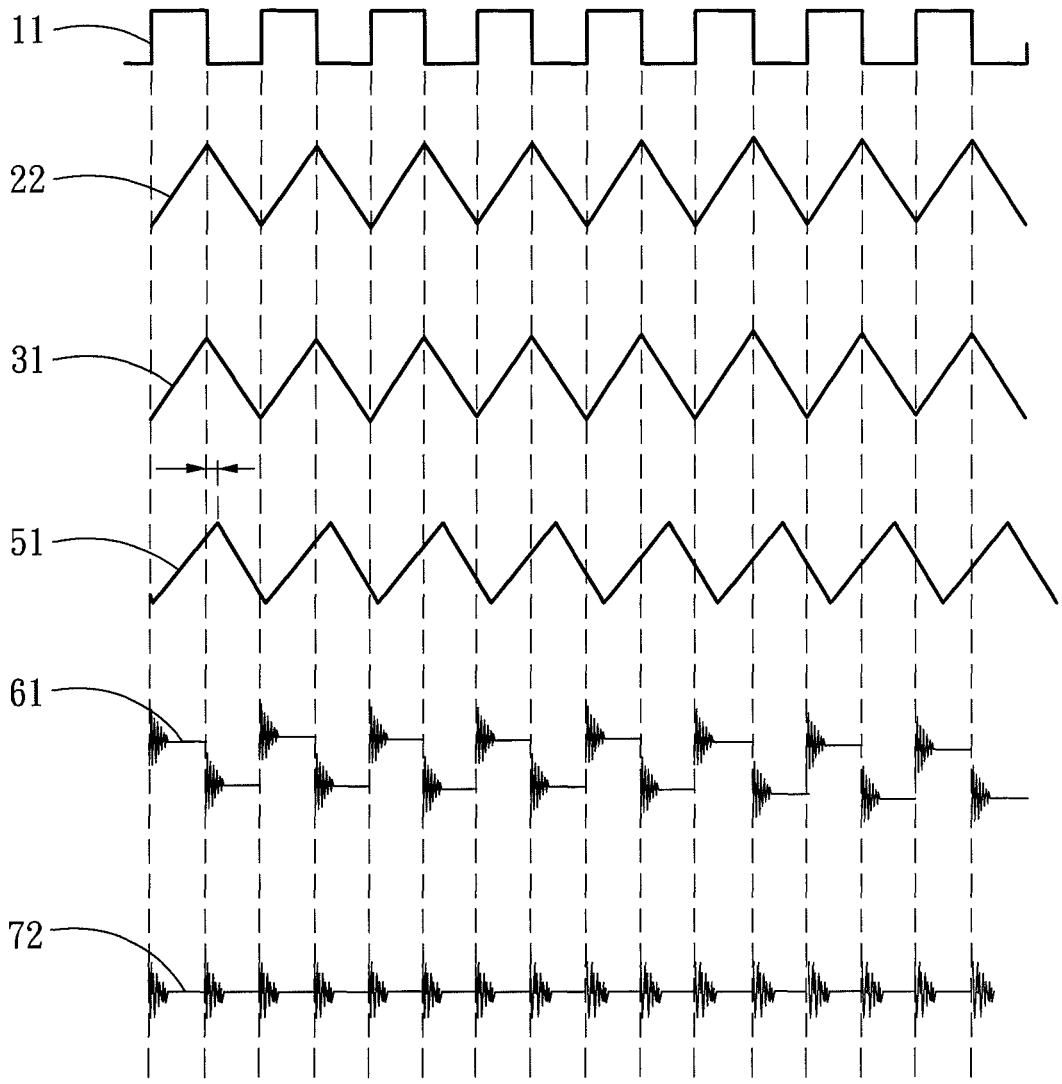
FIG. 3B is a diagram showing the waveform of signals according to one embodiment of the present invention.

Refer to FIG. 3A and FIG. 3B. FIG. 3A is a block diagram schematically showing the architecture of a high-linearity testing stimulus signal generator according to one embodiment of the present invention. FIG. 3B is a diagram showing the waveform of signals according to one embodiment of the present invention. The present invention proposes a high-linearity testing stimulus signal generator, which comprises a signal collection unit 10, a waveform conversion unit 20, a first voltage-to-current conversion unit 30, a delay unit 40, a second voltage-to-current conversion unit 50, a current comparison unit 60, an error calculation unit 70, and a compensation unit 80.

Figure 4:
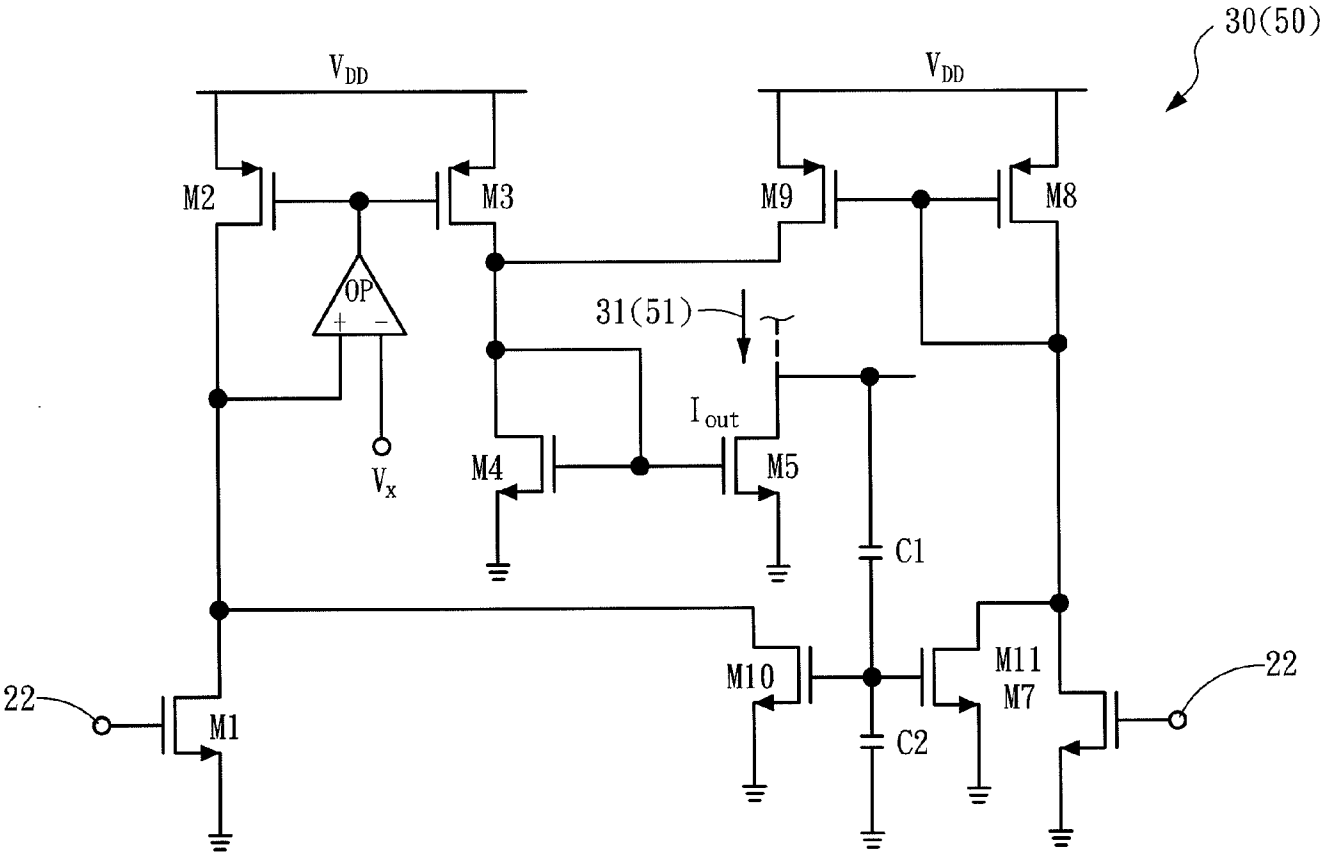
FIG. 4 is a circuit diagram showing a voltage-to-current conversion unit according to one embodiment of the present invention.

The signal collection unit 10 receives an input current signal 11 and outputs a signal. The waveform conversion unit 20 connects with the signal collection unit 10, converts the signal output by the signal collection unit 10 into a triangular wave voltage signal 21, and outputs the triangular wave voltage signal 21 via a voltage output terminal 22. It should be particularly mentioned herein that the triangular wave voltage signal 21 is unstable unless it is linearly modified. The details thereof will be described later. The first voltage-to-current conversion unit 30 and the delay unit 40 connect with the voltage output terminal 22 of the waveform conversion unit 20. The first voltage-to-current conversion unit 30 converts the triangular wave voltage signal 21 into a first current signal 31. The delay unit 40 delays propagation time of the triangular wave voltage signal 21. The second voltage-to-current conversion unit 50 connects with the delay unit 40 and converts the delayed triangular wave voltage signal 21 into a second current signal 51. Refer to FIG. 4 a circuit diagram showing a voltage-to-current conversion unit according to one embodiment of the present invention. Both the first and second voltage-to-current conversion units 30 and 50 use the same circuit to perform voltage-to-current conversion.

Figure 5:
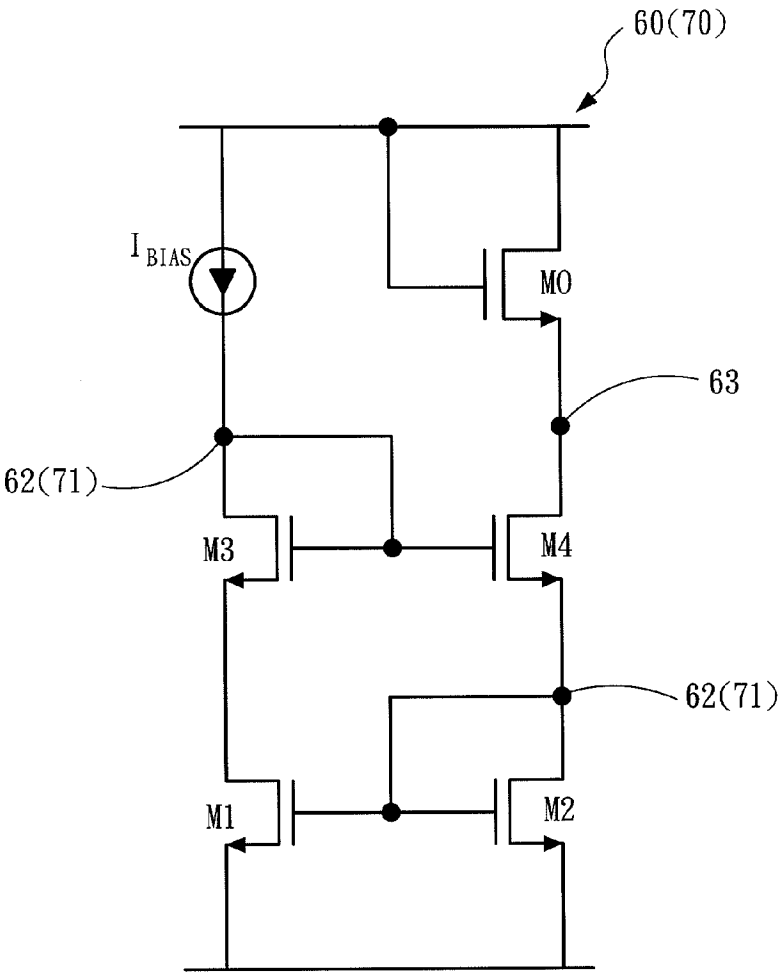
FIG. 5 is a circuit diagram showing a current subtractor according to one embodiment of the present invention.

The current comparison unit 60 connects respectively with the first voltage-to-current conversion unit 30 and the second voltage-to-current conversion unit 50 to receive the first current signal 31 and the second current signal 51 and then perform comparison thereof to output a current difference signal 61. In one embodiment, the current comparison unit 60 is a current subtractor. Refer to FIG. 5 for a circuit diagram showing a current subtractor according to one embodiment of the present invention. The current comparison unit 60 has two current input terminals 62 to receive the first and second current signals 31 and 51. The current comparison unit 60 has an output terminal 63 to output the current difference signal 61. The first current signal 31 is basically similar to the second current signal 51 except there is a time difference existing therebetween. In current comparison, the subtraction of the second current signal 51 and the first current signal 31 is performed to obtain the current difference signal 61, which is similar to a square wave signal.

The present invention may further have a reference current output unit 90 connecting with a current input terminal 71 of the error calculation unit 70 and providing a reference signal 91 for the error calculation unit 70 to perform error calculation. The error calculation unit 70 connects with the output terminal 63 of the current comparison unit 60 to receive the current difference signal 61. In one embodiment, the error calculation unit 70 is a current subtractor, which respectively receives the reference signal 91 and the current difference signal 61 to perform error calculation and then output an error signal 72. If the triangular wave voltage signal 21 is a nonlinear signal, the current difference signal 61 is not an accurate square wave signal. However, the reference signal 91 is a standard square wave signal. Therefore, the error calculation unit 70 calculates the difference between the current difference signal 61 and the reference signal 91 to obtain the error signal 72. In one embodiment, the error signal 72 is a current signal.

The compensation unit 80 connects with the error calculation unit 70 to receive the error signal 72 and then perform signal compensation to output a compensation signal 81 to the signal collection unit 10. Thus is formed a feedback mechanism. In one embodiment, the compensation unit 80 performs multiple amplification to the error signal 72 to obtain the compensation signal 81. In signal compensation, the compensation signal 81 is used to promote the linearity of the triangular wave voltage signal 21.

Figure 6:
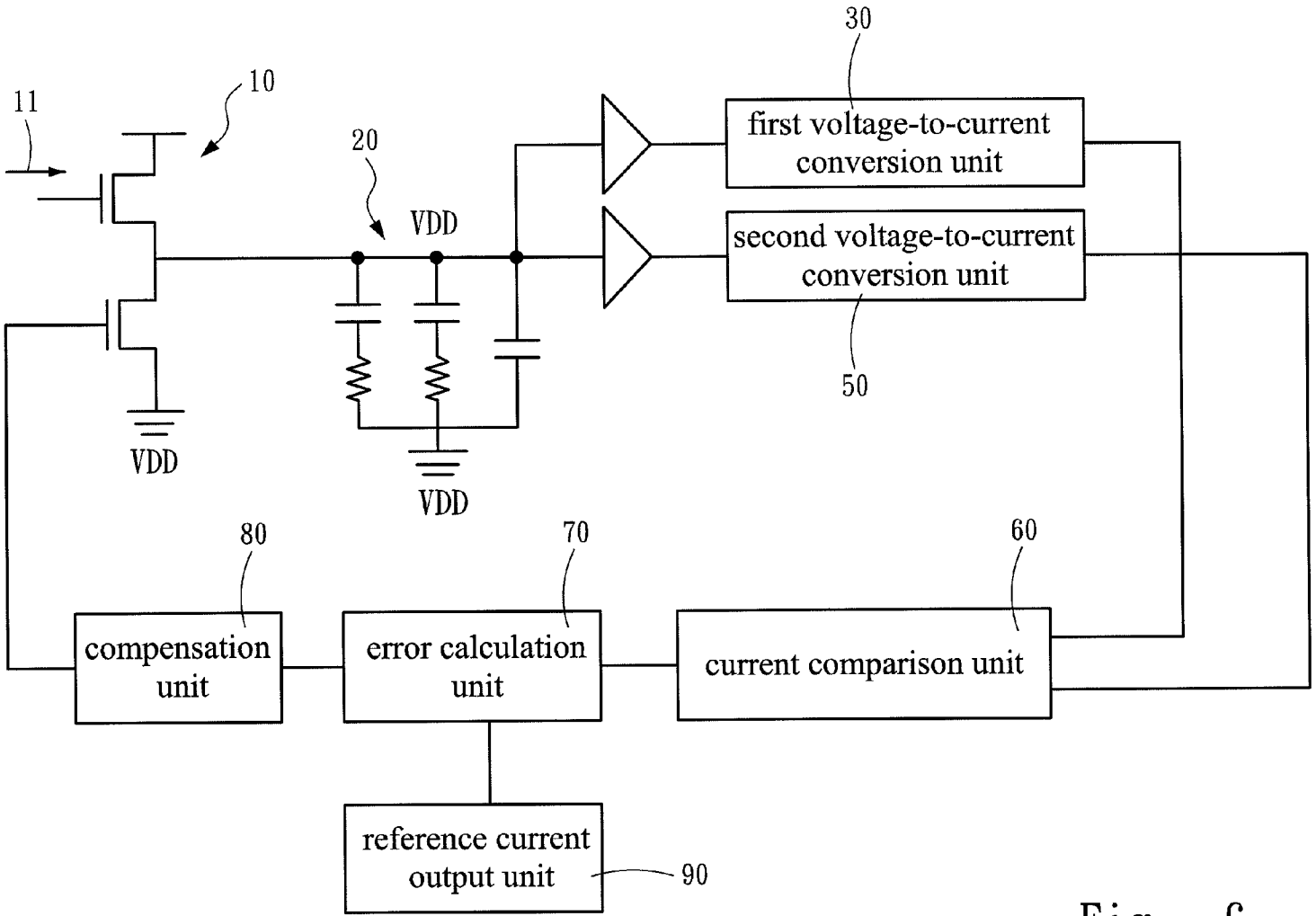
FIG. 6 is a circuit diagram showing a high-linearity testing stimulus signal generator according to one embodiment of the present invention.

Refer to FIG. 6 a circuit diagram schematically showing a high-linearity testing stimulus signal generator according to one embodiment of the present invention. The signal collection unit 10 uses a p-type MOSFET (Metal Oxide Semiconductor Field Effect Transistor) and an n-type MOSFET to perform voltage-to-current conversion. The waveform conversion unit 20 is a circuit containing capacitors and resistors, thus the capacitors are charged and discharged to convert the triangular wave voltage signal 21. In one embodiment, there are two delay units 40 connecting with the waveform conversion unit 20 and respectively connecting with the first voltage-to-current conversion unit 30 and the second voltage-to-current conversion unit 50. The delay units 40 respectively delay the signals to the first voltage-to-current conversion unit 30 and the second voltage-to-current conversion unit 50 through different propagation time, whereby the signal received by the second voltage-to-current conversion unit 50 is slower than the signal received by the first voltage-to-current conversion unit 30 to achieve signal delaying effect. The compensation unit 80 performs multiple amplification to the error signal 72 by using the transistors, which is a skill known in the art and will not be repeated herein. The compensation signal 81, which has been amplified, is a voltage signal. The voltage signal is converted into a current signal by the transistors of the signal collection unit 10.

In conclusion, the present invention uses the feedback mechanism of the compensation unit 80 to perform linearity modification and promote the linearity of the triangular wave voltage signal 21. The present invention performs the feedback modification via a current mechanism. As the current mode provides high response speed, the present invention is exempted from the interference caused by device drift. Therefore, the present invention can effectively promote the linearity of the testing stimulus signals.

What is claimed is:

1. A high-linearity testing stimulus signal generator comprising a signal collection unit receiving an input current signal;

a waveform conversion unit connecting with the signal collection unit, converting the signal output by the signal collection unit into a triangular wave voltage signal, and outputting the triangular wave voltage signal via a voltage output terminal;

a first voltage-to-current conversion unit connecting with the voltage output terminal of the waveform conversion unit and converting the triangular wave voltage signal into a first current signal;

a delay unit connecting with the voltage output terminal of the waveform conversion unit and delaying propagation time of the triangular wave voltage signal;

a second voltage-to-current conversion unit connecting with the delay unit and converting the delayed triangular wave voltage signal into a second current signal;

a current comparison unit connecting respectively with the first voltage-to-current conversion unit and the second voltage-to-current conversion unit to receive the first current signal and the second current signal and then perform comparison thereof to output a current difference signal;

an error calculation unit connecting with an output terminal of the current comparison unit to receive the current difference signal and perform error calculation to output an error signal; and a compensation unit connecting with the error calculation unit to receive the error signal and perform signal compensation to output a compensation signal to the signal collection unit.

2. The high-linearity testing stimulus signal generator according to claim 1, wherein the current comparison unit is a current subtractor performing subtraction of the first current signal and the second current signal to output the current difference signal.

3. The high-linearity testing stimulus signal generator according to claim 1 further comprising a reference current output unit connecting with an input terminal of the error calculation unit and providing a reference signal for the error calculation unit to perform the error calculation.

4. The high-linearity testing stimulus signal generator according to claim 3, wherein the reference signal is a current signal, and wherein the error calculation unit is a current subtractor, which performs subtraction of the reference signal and the current difference signal to output the error signal.

5. The high-linearity testing stimulus signal generator according to claim 4, wherein the error signal is a current signal.

6. The high-linearity testing stimulus signal generator according to claim 1, wherein the compensation unit performs multiple amplification to the error signal to obtain the compensation signal.

* * * * *